US006491563B1

(12) United States Patent
Bailey

(10) Patent No.: US 6,491,563 B1
(45) Date of Patent: Dec. 10, 2002

(54) BALL AND SOCKET CONSTRUCTION TOY

(76) Inventor: Scott Bailey, 905 Nowita Pl., Venice, CA (US) 90291

( * ) Notice: Subject to any disclaimer, the term of this patent is extended or adjusted under 35 U.S.C. 154(b) by 0 days.

(21) Appl. No.: 09/556,997

(22) Filed: Apr. 24, 2000

(51) Int. Cl.[7] ..... A63H 33/12
(52) U.S. Cl. ..... 446/122; 446/120; 446/126
(58) Field of Search ..... 446/122, 123, 446/124, 125, 126, 120, 102; 434/278; 52/81.3, 655.2; 403/56, 122, 181, 170, 217, 218

(56) References Cited

U.S. PATENT DOCUMENTS 3,286,391 A * 11/1966 Mengeringhausen ..... 403/176
3,458,949 A * 8/1969 Young ..... 446/120
3,597,874 A * 8/1971 Ogsbury ..... 46/29
3,747,261 A * 7/1973 Salem ..... 46/25
3,882,650 A * 5/1975 Gugliotta ..... 403/176
4,161,088 A * 7/1979 Gugliotta et al. ..... 403/176
4,480,418 A * 11/1984 Ventrella ..... 403/176
4,781,644 A * 11/1988 Yoshida ..... 446/126
5,318,470 A * 6/1994 Denny ..... 52/655.2
6,264,522 B1 * 7/2001 Dickson ..... 446/120

* cited by examiner

*Primary Examiner*—Derris H. Banks
*Assistant Examiner*—Urszula M. Cegielnik
(74) *Attorney, Agent, or Firm*—Richard L. Mikesell, Esq.

(57) ABSTRACT

A gravity-deformable toy is formed by interlocking a plurality of flexible struts with a plurality of nodes. Each strut has a truncated sphere on at least one end thereof and each node has a plurality of spherical cavities defined therein. A truncated sphere of a strut is received in a spherical cavity to lock the strut to the node. Each of the struts has a center uniform cylinder having an outer diameter, and a diameter of the truncated sphere. The diameter of the truncated sphere is larger than the diameter of the center uniform cylinder. Each of the cavities has a circular entrance which has a diameter equal to the diameter of the central uniform cylinder and each of the cavities has a diameter equal to the diameter of the truncated sphere. When assembled, the toy is deformed by gravity when pendently supported.

4 Claims, 7 Drawing Sheets

BALL AND SOCKET CONSTRUCTION TOY

CROSS-REFERENCE TO RELATED APPLICATION

Not Applicable

REFERENCE REGARDING FEDERAL SPONSORSHIP

Not Applicable

REFERENCE TO MICROFICHE APPENDIX

Not Applicable

BACKGROUND OF THE INVENTION

1. Field of the Invention

This invention relates to a construction toy consisting of a system of flexible struts and resilient spherical nodes so configured that each strut joins with each node in a ball and socket joint.

2. Discussion of the Prior Art

The use of construction elements for toys is common, and valuable. These toys teach spatial relationships, mechanical skills, and even artistic skills. There are numerous toys of the construction type that have been patented. Some of them are:

U.S. Pat. No. 5,916,006 ('006) teaches toys made of elements of various shapes, all of which contain wire cores. such that they can be bent into fanciful shapes, and connected by wrapping the elements about each other.

U.S. Pat. No. 3,176,428 ('428) teaches flexible hollow tubes or straws that are connected by means of coupling members that are hollow, but contain an interior pin such that the hollow tube goes within the member, but has the interior pin in it.

U.S. Pat. No. 3,830,011 ('011) is an inexpensive toy comprising rigid tubular elements that are connected by stamped members having protrusions to fit within the tubular elements.

U.S. Pat. No. 3,998,003 ('003) teaches rigid cylindrical struts that are inserted into corresponding cylindrical cavities in linking members, being held in the cavities by friction between the cylindrical strut and the cylindrical hole.

U.S. Pat. No. 3,796,004 ('004) teaches a toy with flexible struts with tapered ends, the ends being inserted into polygonal connecting elements in the form of envelopes. Multiple struts introduced into the envelopes bear on each other, causing their retention in the envelope.

U.S. Pat. Nos. 3,975,858 ('858), 4,579,538 ('538), 3,432,960 ('960) are of general interest in the field of construction toys.

All of the patents cited have the problem of being either too readily disassembled, i.e., they fall apart, or they are too difficult to disassemble when another configuration is desired. Those toys with rigid struts do not provide the wealth of finished shapes that those with flexible struts do, and all of the strut/connecting devices provide for either no or very little swiveling on the part of the strut inserted in the connecting means.

SUMMARY OF THE INVENTION

The toy of the instant invention comprises flexible struts that are inserted into flexible nodes, the struts having balls formed on the end, and the nodes having corresponding sockets formed therein, whereby each joint is a semi-closed ball and socket joint, allowing not only for flexibility, but reliable retention of the struts by the nodes. The nodes are of a compressible material and contain a plurality of equatorial sockets about each of the three axes of the nodes. The struts are preferrably flexible, but of course could be rigid along all or part of their length. They preferably come in a variety of lengths, those lengths being multiples of each other when assembled.

DETAILED DESCRIPTION OF THE INVENTION

Figure 1:
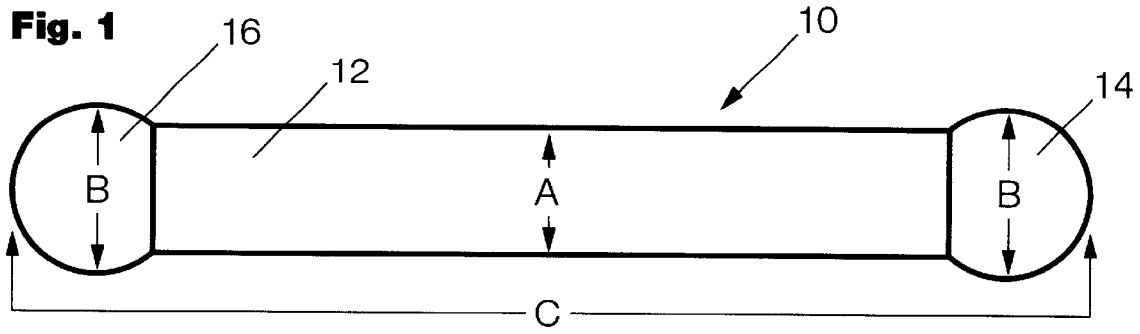
FIG. 1 is a side elevation of a cylindrical strut.

FIG. 1 shows a strut 10 having a uniform cylindrical center section 12 of diameter A. Appended to each end of the cylindrical center section 12 are truncated spheres 14 and 16, each being joined or molded to the center section 12 such that there is a smooth transition from center section 12 to truncated spheres 14 and 16. The truncated spheres are congruent to each other, and each has a major diameter B. The strut has an overall length C. in practice, the entire strut 10 is preferable molded of one piece of resilient flexible polymer.

Figure 2:
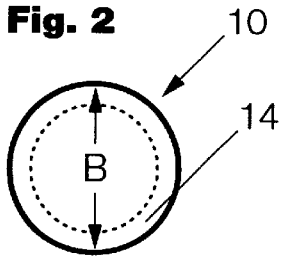
FIG. 2 is an end elevation of the cylindrical strut of FIG. 1.

FIG. 2 shows an end view of the strut 10, the entire body of which is obscured by the sphere 10 having a diameter B.

Figure 3:
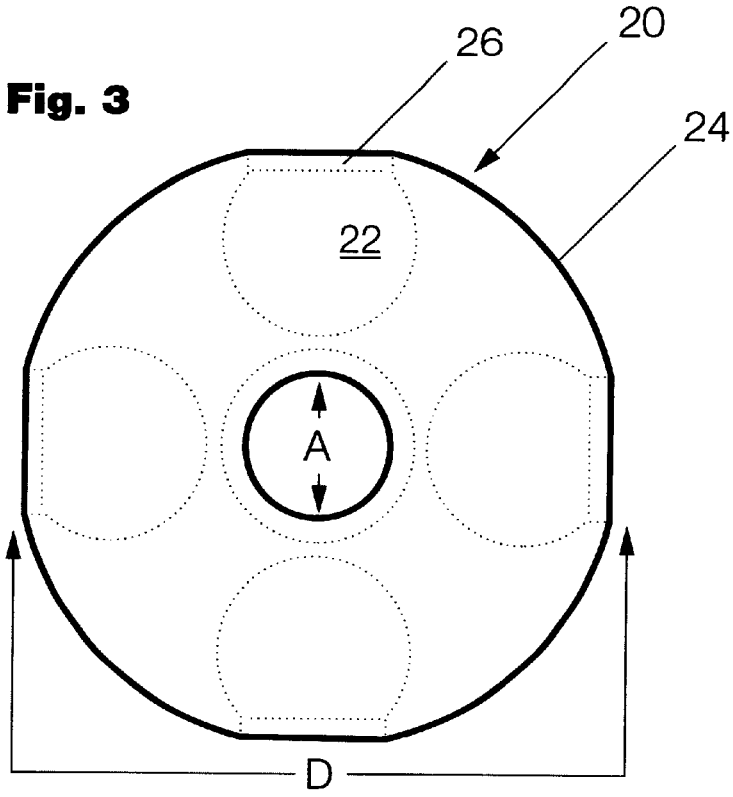
FIG. 3 is a side view of a symmetrical spherical node.

FIG. 3 shows a resilient node 20 in side view. It is a symmetrical sphere and has six cavities 22 arrayed symmetrically about it on the three equatorial axes, 4 cavities per axis.

Figure 4:
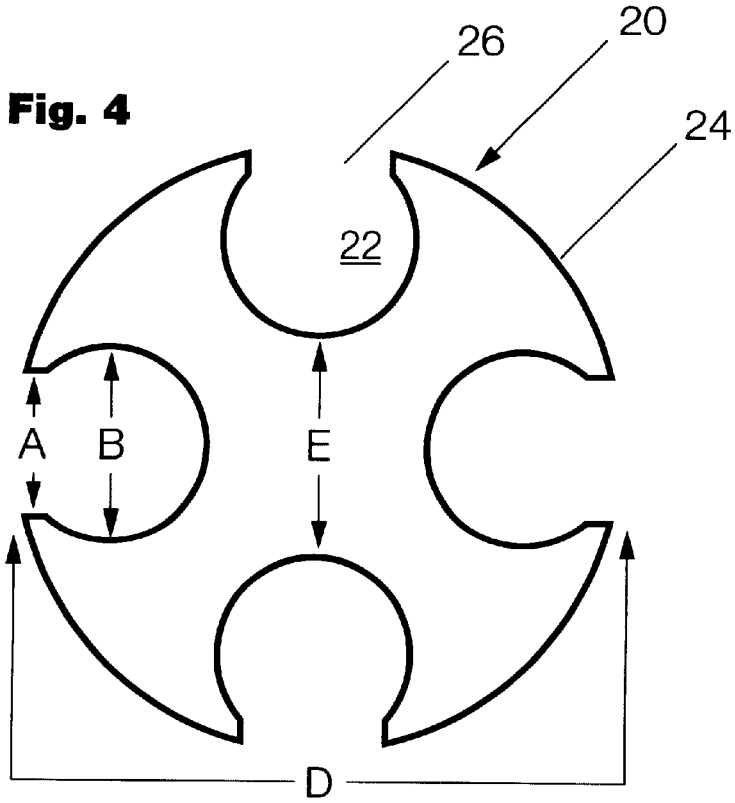
FIG. 4 is a cross-sectioned side view of the spherical node of FIG. 3

FIG. 4 shows a sectioned side view of the node 20. It will be noted that the cavities 22 do not have cylindrical sides. Rather, they are spherical, having a major diameter B, the same as that of the spheres 14 and 16 at the end of the strut 10. The cavities 22 are of a depth B, from the surface 24 of the sphere 20. Put another way, the outer perimeter of the hole 22 would be tangential to the outer perimeter of the node 20, were there not a hole opening 26. The opening 26 to the hole 22 is of a diameter A, being the same as the diameter of the cylindrical shaft 12 of the strut 10. Any two opposing cavities of depth B are separated by an interior web of thickness E of the node. It can be seen that the diameter D of the entire spherical node 20 is B+B=E.

Figure 5:
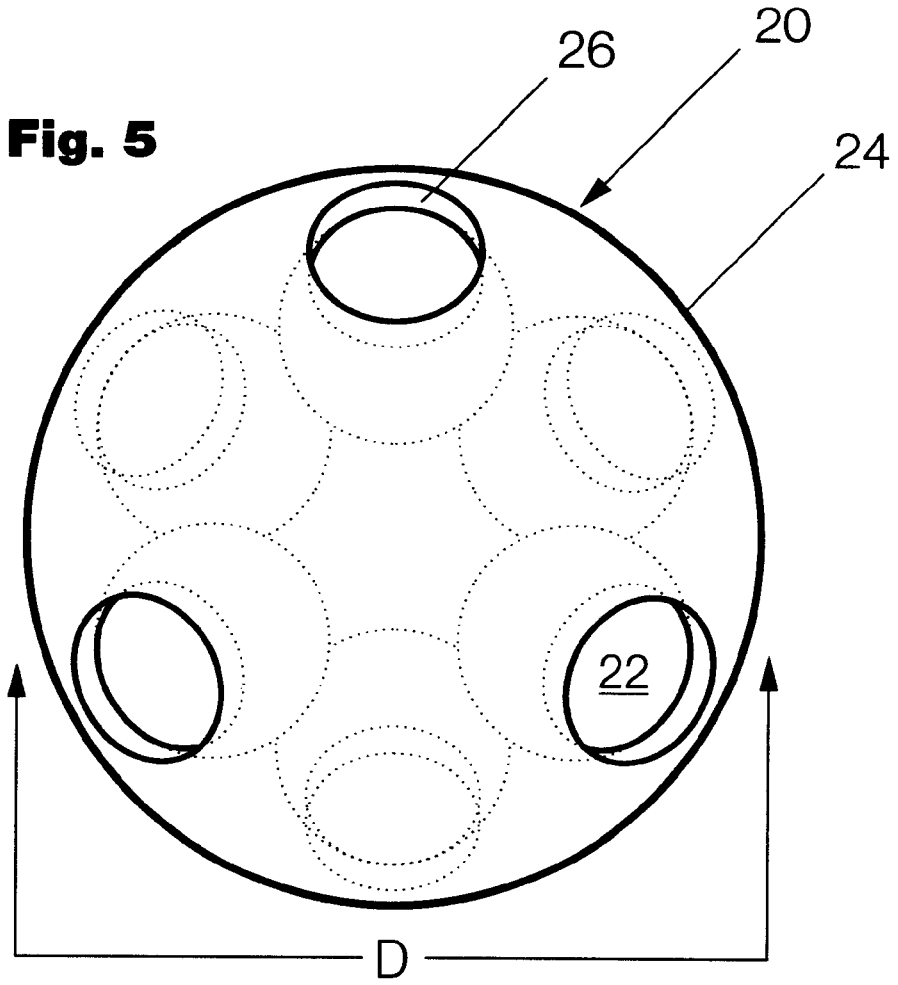
FIG. 5 is a perspective view of the spherical node of FIG. 3

FIG. 5 shows a perspective view of the node 20. In this view, cavities 22 are visible.

Figure 6:
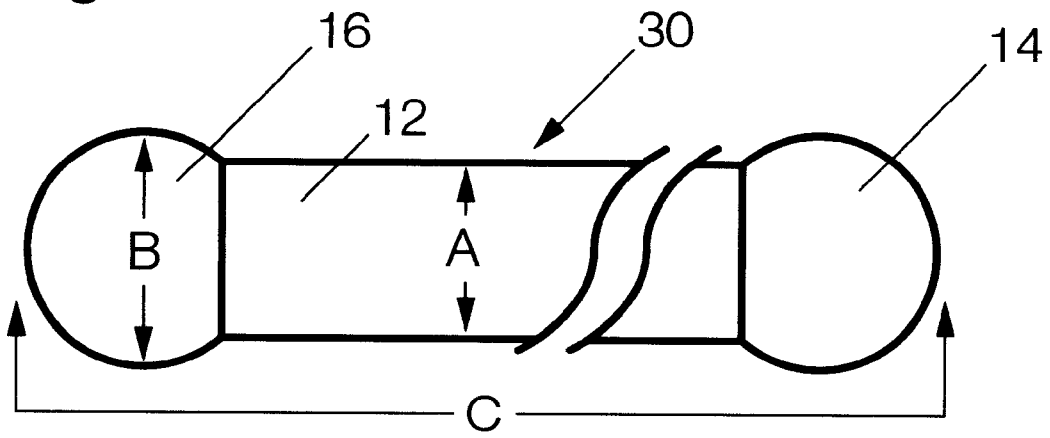
FIG. 6 is another strut, of different length than the strut of FIG. 1.

FIG. 6 shows another strut 30. It is identical in dimensions to strut 10, except that it has a different length F. while of course any lengths can be assigned to the lengths of the struts, it has been found that more symmetrical construction results if the struts are of such lengths that they will be multiples of each other when assembled in a construction. To do so, the interior web thickness E of a single connecting node must be taken into consideration. Specifically, if two struts 10 of length C are desired to be the same length F as a single longer strut 30 when joined together, each strut 10 should be of a length such that 2C+E=F. If three struts 10 are desired to be of the length of a single strut 30 when assembled, then each strut 10 should be of the length such that 3C+2E=F.

Figure 7:
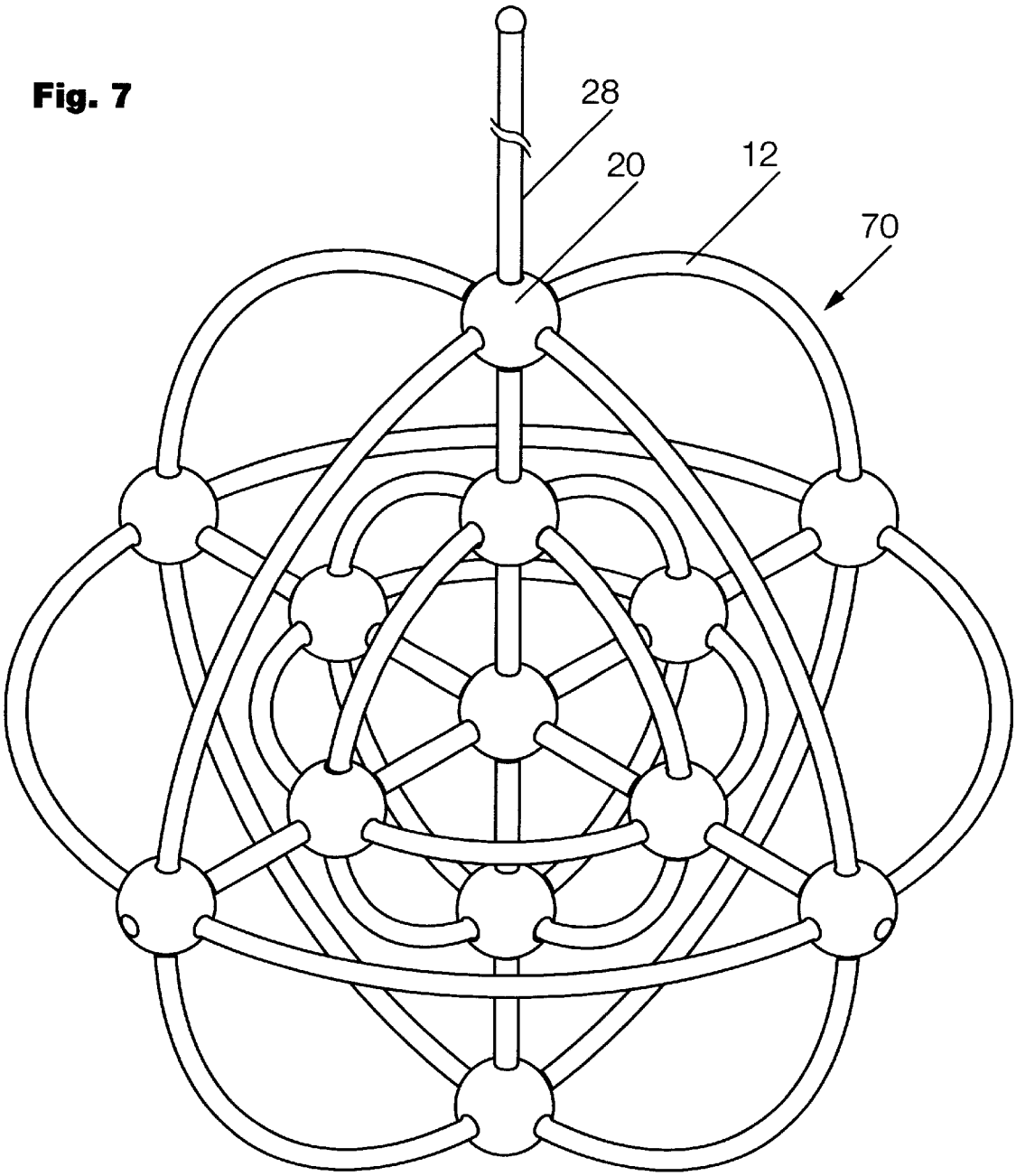
FIG. 7 is a perspective view of an exemplar of an assemblage of struts and nodes of the instant invention.

FIG. 7 shows an assembled group 70 of the struts and nodes of the instant invention. It will be noted that the struts 10 have been inserted into the cavities. Of course, one or more of the struts could be formed intergally with the node. The difference in diameter A of both the cylindrical shaft of the strut 10 and the opening 26 of the cavity 22 on the one hand and the width B of both the cavity 22 and the truncated sphere 14 and 16 on the other serves to firmly retain the strut 10 in the node 20. Indeed, if one of either the strut 10 or the node 20 were not of flexible material, the greater diameter B of the strut's spherical end 14 or 16 would not allow it to pass through the smaller cavity opening 26, which is diameter A. In practice, both the node and the strut are of flexible, compressible plastic.

It will be noted that when the truncated sphere end 14 or 16 of a strut is inserted into a cavity 22, a ball and socket joint is formed. Again, when the node 20 is of a flexible material, that allows the struts 10 or 30 to be rotated within the cavity 22.

With respect to the construction 70 in FIG. 7, it is best described as a four-dimensional sphere, much as a tesseract is a four dimensional cube. When hung from the flexible support member 28 (which is another strut) and that support member is given a twisting impulse, the construction will spin. Centripetal force will cause it to form an oblate spheroid. When at the end of one direction of spin, it will reverse, and continue to spin, this time in the opposite direction. Different shaped constructions will deform in different manners, giving rise to interesting possibilities of play.

It will be noted that (not counting the support member 28), the construction 70 is constructed of thirteen nodes, twelve long struts, twelve medium struts, and twelve short struts.

The preferred mode of practicing the instant invention is to provide nodes 20 of a diameter (D) of 25 mm., with cavities of diameter (B) of 8 mm, and openings of diameter (C) of 6 mm. It can be seen that those dimensions dictate that the node have an interior thickness (E) of 9 mm, that the struts have a cylindrical diameter (C) of 6 mm, and spherical ends of diameter (B) of 8 mm. Struts of different lengths are desirably provided. In practice, three struts bearing the relationship of 1:2:4 (taking into account the thickness of web E of connecting nodes) are useful, having lengths of 87 mm, 183 mm, and 375 mm. Another short strut of about 51 mm is a useful adjunct in many constructions.

Figure 8:
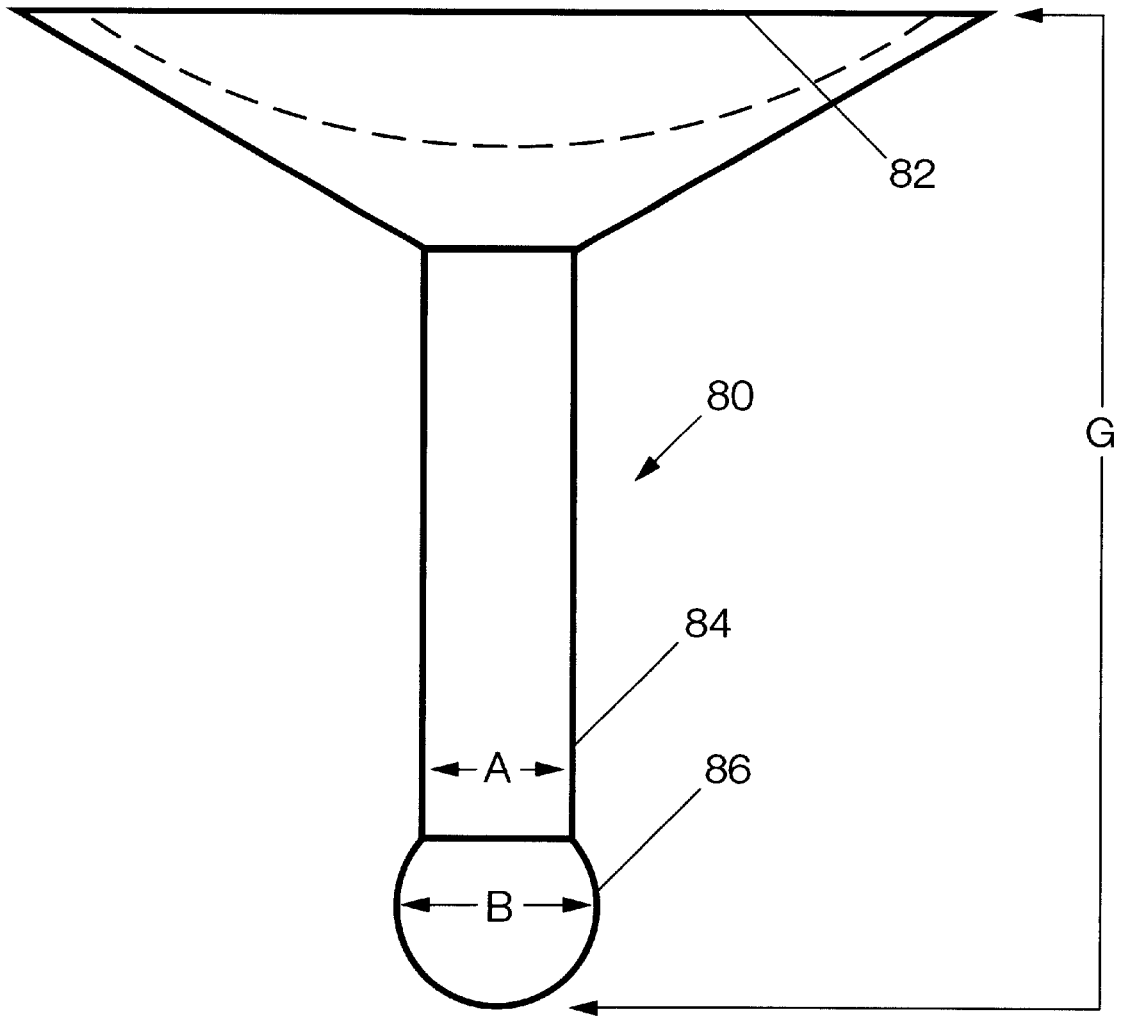
FIG. 8 is a side elevation of an exemplar of an adjunct piece, mateable with constructions made using the instant invention for hanging or displaying them.
Figure 9:
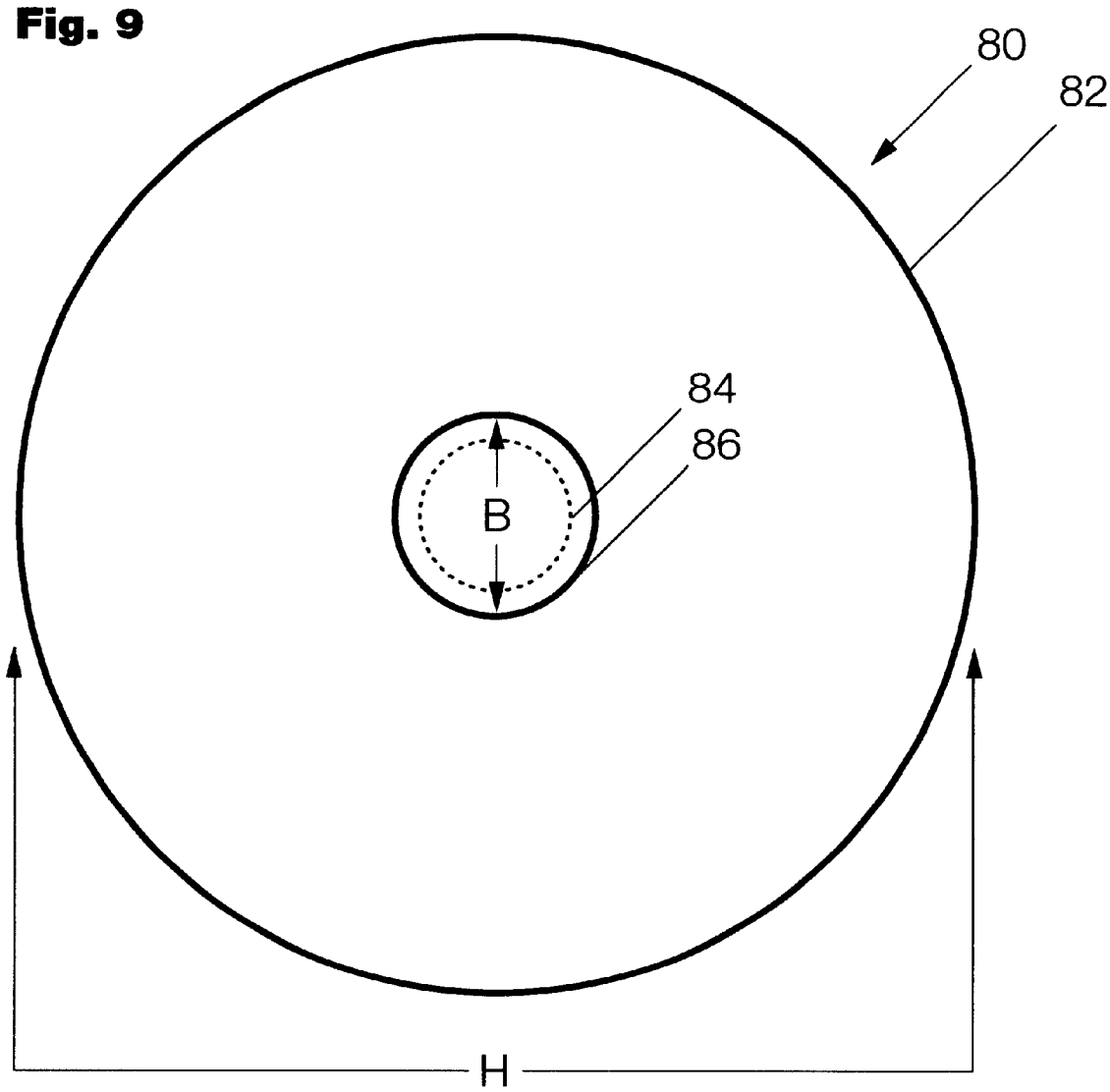
FIG. 9 is an end view of the exemplar of FIG. 8.

Given the ball and socket construction peculiar to the node and struts, it can be seen that other constructions can be made using another piece having a protrusion of strut/ball character, and the other end having, for instance, a fastening device. FIG. 8, for instance, shows a piece 80 having a suction cup 82 appended to a strut 84, again of diameter A, with a ball 86 at the other end of the strut 84, the ball 86 again having a diameter of B. The overall length G of the piece 84 is dictated to some extent by the nature of the material of which at least the strut portion 84 is fabricated. If that material is too flexible, the strut will sag when the device is attached horizontally. FIG. 9 shows and end view of the suction cup device of FIG. 8, with the cup itself depicted as having a diameter H. Of course, if the device of FIGS. 8 and 9 is hung vertically, the flexible materials used as indicated above will be satisfactory. The intent is for the device 80 to hold a construction (not shown) of the nodes and struts of the instant invention to suspend it from a flat surface, horizontally or vertically.

Figure 10:
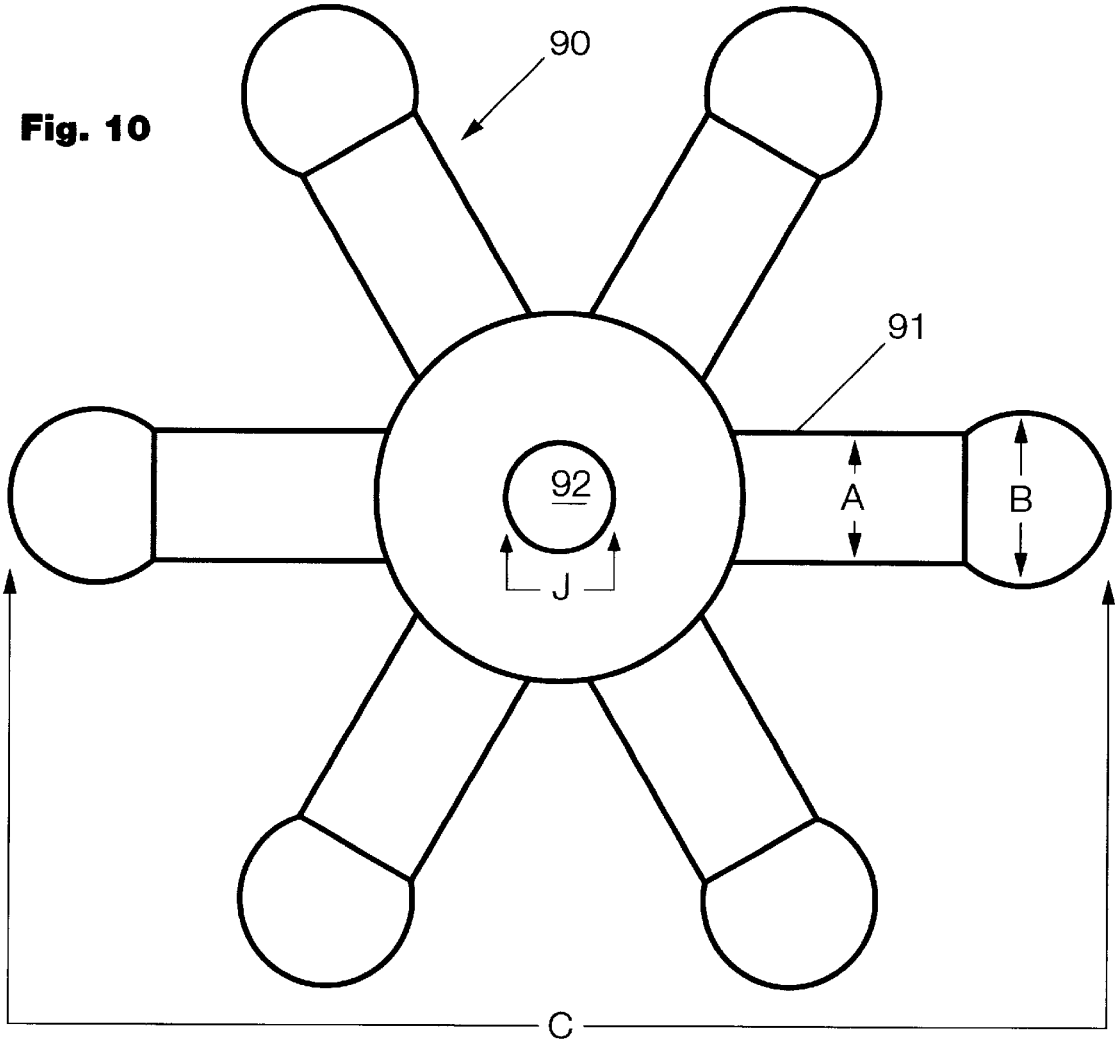
FIG. 10 is a top view of another example of an adjunct piece, being of a toroidal shape.
Figure 11:
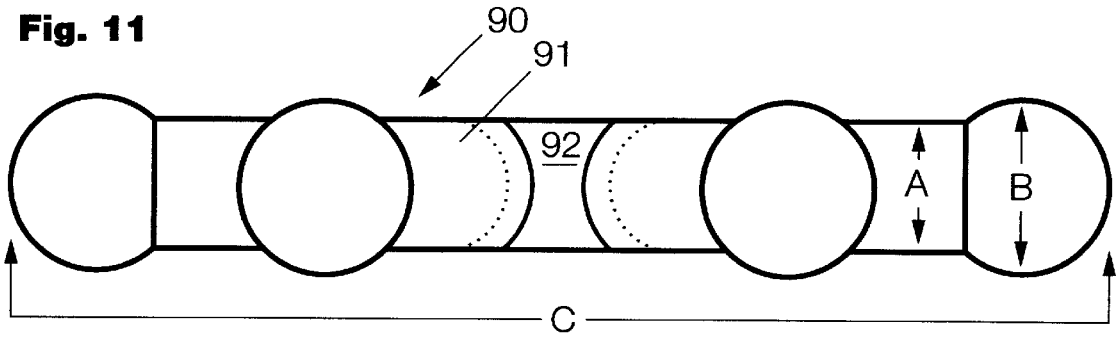
FIG. 11 is a side view of the piece of FIG. 10.

FIGS. 10 and 11 show another adjunct piece 90, this time of a toroidal or "snowflake" shape. Its integrally formed struts 91 have the standard diameter A, and are terminated by the now-familiar truncated spheres of diameter B. it has a center hole of diameter J, that diameter being slightly smaller than the diameter A of the cylindrical part of the struts. That slightly smaller diameter allows it to retain its position when a strut (not shown) is inserted through the center hole 91. It is ideally of a diameter C, that being the diameter of one of the standard struts of FIG. 6.

It is clear that one of ordinary skill in the art may make alterations in the device specifically described above without departing from the claimed invention, which is described by the following claims.

I claim:

1. A construction toy comprising: a plurality of resilient node elements and a plurality of resilient flaccid, one-piece strut elements removably interconnected with said node elements to form flexible multi-dimensional configurations, each of said strut elements formed as a center uniform cylinder, at each end of which are congruent truncated spheres of larger diameter than the diameter of the cylinder each strut having a length, each of said node elements configured as a flexible sphere with a plurality of truncated spherical cavities formed therein, each of said cavities having a diameter congruent to the truncated sphere elements of said struts, and said cavities having circular openings to the exterior of the node of a diameter congruent to the cross sectional diameter of the cylindrical portion of said struts, each of said spherical nodes having an outer diameter equal to twice the diameter of a cavity plus an interior web thickness, the length of one strut being a multiple of the length of another strut plus one less than the multiple multiplied times the web thickness, said struts and said node elements being connected together and forming a gravity-deformable toy.

2. The construction of claim 1 in which the node elements have six cavities equally spaced from each other on the three equatorial axes of the nodes.

3. The construction of claim 1 additionally including at least one other strut member having only one spherical end, the other end being a fastening device.

4. The construction of claim 1 further including a toroidal shaped part mateable with the struts elements and nodes elements, the toroidal shaped part having integrally formed therewith a plurality of equally spaced radiating struts extending from the outer perimeter thereof, said radiating struts being terminated by flexible truncated spheres.

* * * * *